US010028623B1

(12) United States Patent
Smith et al.

(10) Patent No.: US 10,028,623 B1
(45) Date of Patent: Jul. 24, 2018

(54) UNITARY SHOWER CURB SYSTEM AND METHOD OF INSTALLATION OF A UNITARY SHOWER CURB SYSTEM

(71) Applicants: Fredrick Michael Smith, Sunrise, FL (US); Jason Eric Smith, Wellington, FL (US)

(72) Inventors: Fredrick Michael Smith, Sunrise, FL (US); Jason Eric Smith, Wellington, FL (US)

( * ) Notice: Subject to any disclaimer, the term of this patent is extended or adjusted under 35 U.S.C. 154(b) by 423 days.

(21) Appl. No.: 14/191,662

(22) Filed: Feb. 27, 2014

Related U.S. Application Data

(60) Provisional application No. 61/774,380, filed on Mar. 7, 2013.

(51) Int. Cl.
*A47K 13/00* (2006.01)
*A47K 3/40* (2006.01)

(52) U.S. Cl.
CPC ..... *A47K 3/405* (2013.01)

(58) Field of Classification Search
CPC ..... A47K 3/405; A47K 3/40; A47K 3/283; A47K 3/284; A47K 3/285
USPC ..... 4/253, 612, 613, 614; 52/265, 35, 608
See application file for complete search history.

(56) References Cited

U.S. PATENT DOCUMENTS 3,139,627 A * 7/1964 Rice ..... A47K 3/28 220/918
4,473,911 A 10/1984 Germain
4,720,876 A * 1/1988 Tomei ..... A47K 3/36 4/600
5,092,002 A * 3/1992 Powers ..... A47K 3/40 4/596
6,006,375 A * 12/1999 Carr ..... A47K 3/40 4/609
6,643,863 B1 * 11/2003 Gerber ..... A47K 3/40 4/613
7,562,495 B1 * 7/2009 Fairchild ..... A47K 3/40 4/613
8,141,183 B2 * 3/2012 Cook ..... A47K 3/40 4/613

(Continued)

OTHER PUBLICATIONS http://www.walmart.com/ip/Tile-Redi-Z-Flashing-Kit-Fits-All-66-W-x-42-D-Shower-Base-Models/14472319.

(Continued)

*Primary Examiner* — Benjamin R Shaw
(74) *Attorney, Agent, or Firm* — H. John Rizvi; Gold & Rizvi, P.A.

(57) ABSTRACT

The present invention is directed toward a prefabricated shower curb system for easily providing a shower area with a water-retaining curb. The prefabricated shower curb system is formed mainly by a body that has a C-shape and includes a recess, and that is preferably manufactured from a rigid foam material such as expanded polystyrene. The body is mounted onto a wood, aluminum, or other support member arranged along a shower floor entrance area. The support member is secured to the shower walls or to an adjacent support member through brackets. A waterproof liner is used to cover and protect the support member. An adhesive material and the tapered interior design of the body recess allow the curb to be firmly secured in place on the supper member. The extraordinary strength, light-weight, low-cost, and easiness of size adjustment make the system novel in the industry.

9 Claims, 7 Drawing Sheets

(56) References Cited

U.S. PATENT DOCUMENTS

| | | | | |
|---|---|---|---|---|
| 2003/0089059 | A1* | 5/2003 | Kirby | A47K 3/40 52/265 |
| 2003/0172453 | A1* | 9/2003 | Peterson | A47K 3/40 4/613 |
| 2005/0028268 | A1* | 2/2005 | Hess | A47K 3/40 4/584 |
| 2007/0157538 | A1* | 7/2007 | DeGarmo | A47K 3/40 52/608 |

OTHER PUBLICATIONS http://www.amazon.com/Schluter-Systems-Kerdi-Shower-Curb/dp/B003NFG1RA/ref=sr_1_3?ie=UTF8&qid%E2%80%A6.
http://www.homedepot.com/p/Goof-Proof-Shower-Kirb-Perfect-shower-curb-building-Kit-KP-543/202822173.
Tile Redi Z Flashing Kit http://www.walmart.com/ip/Tile-Redi-Z-Flashing-Kit/36869682.
Schluter Kerdi Shower Curb http://www.amazon.com/Schluter-Systems-Kerdi-Shower-Curb/dp/B003NFG1RA/ref=sr_1_1?ie=UTF8&qid=1409766186&sr=8-1&keywords=schluter+kerdi+shower+curb.
Goof Proof Shower Kirb-Perfect shower curb building Kit http://www.homedepot.com/p/Goof-Proof-Shower-Kirb-Perfect-shower-curb-building-Kit-KP-543/202822173?keyword=goof+proof+shower+kirb-perfect.

* cited by examiner

UNITARY SHOWER CURB SYSTEM AND METHOD OF INSTALLATION OF A UNITARY SHOWER CURB SYSTEM

CROSS-REFERENCE TO RELATED APPLICATIONS

This Non-Provisional Utility Patent Application claims the benefit of U.S. Provisional Patent Application Ser. No. 61/774,380, filed on Feb. 28, 2013, which is incorporated here in its entirety.

FIELD OF INVENTION

The present invention relates to a shower curb, and more specifically, to an adaptable prefabricated shower curb system and a method of installing the prefabricated shower curb system for use in constructing a shower enclosure.

BACKGROUND OF THE INVENTION

Whether a homeowner decides to hire a contractor or take the risk of making modifications to his home himself, it is well-known that the process can be very costly and time-consuming. One such construction project is the installation of a shower, requiring one to install shower walls, a subfloor, a pre-slope, a drain, and a shower curb, to name a few. The shower curb is a structure located at a bottom portion of a shower that prevents water from overflowing out of the shower onto the bathroom floor. In other words, a shower curb is a structure rising up from the shower floor to contain water within the shower stall. A shower curb is typically no higher than any stair riser in the home. It is low enough for an individual to step over in order to get into and out of the shower, while being high enough to keep water within the shower stall.

Shower curbs are typically used when installing tiled shower areas and other shower enclosures that require installation of a structure to prevent the overflow of water. Typically, shower enclosures are built using pre-established construction techniques, and they require many hours to prepare and construct. Prefabricated shower curbs must be individually cut to the proper length. Most shower curbs are made of concrete or other heavy material.

Using modern standard construction methods, a skilled shower installer will start out by framing the area which will define the shower floor. During the initial framing step, several pieces of lumber may be installed at the entrance of the shower area to form the shower curb. Typically, three pieces of lumber will be stacked one on top of the other, forming a three-tier lumber structure defining the shower curb. Commonly used lumber pieces for such purposes are two-by-fours and one-by-fours. As is well-known in the art, the actual dimensions (height by width) for a two-by-four are 1.5 inches by 3.5 inches and the actual dimensions (height by width) for a one-by-four is 0.75 inches by 1.5 inches. The length of the lumber pieces will vary. The lumber pieces will typically be cut to provide a length that will accommodate the width of the shower entrance. The typical shower entrance in the United States is 60 inches wide but may be more or less. For example, a two-person shower stall is typically 72 inches wide. Also, a shower width may be customized according to a homeowner's specifications.

After the lumber is installed, a pre-slope may be created within the frame. The pre-slope, which usually consists of cementation material, is then constructed at a grade of 0.25 inch per linear foot towards the shower drain. The pre-slope ensures that the water is channeled at a particular pitch into the drain. A waterproof shower area liner, also referred to as the shower membrane, may then be placed over the pre-slope and the bottom flange of the shower drain. The top flange of the shower drain is then installed over the waterproof liner properly covering the drain hole. The waterproof liner is then secured to each of the stud walls of the shower at least 8 inches above the subfloor, as is required by many building codes. The waterproof liner also covers the three-tier lumber structure forming the curb. The walls of the shower are then installed, which is well known in the art.

At this point the shower curb is precut and installed, providing a barrier for water containment. Floor mud may then be used to create a base floor for the shower area. By slopping the material at 0.25 inches per linear foot towards the finished shower drain proper drainage is achieved. Once the mortar is cured, the tile is placed and set on the shower base as well as the walls, and, finally, the shower curb.

Prefabricated showers are also desirable to many individuals. One advantage is that the customer can see the product prior to completion. Another advantage is that color matching and additional features such as extra shelves for placing containers and soap can be added prior to the installation itself. Prefabricated showers have the added benefit of providing properly sloped flooring for proper water drainage. Nevertheless, these prefabricated shower enclosures are very expensive. They also have a tendency to be uneven and often give a hollow appearance.

This process of building a finished shower area, including a shower curb, is time consuming and requires experience and skill, especially when constructing the proper slope for the shower floor. The mortar used also requires time to cure, often adding an additional 24 hours to the process. If not executed correctly, the water may not drain properly and could possibly remain in the pan area making the shower floor very wet and slippery, which is dangerous and inconvenient. Additionally, most shower curbs are heavy because they are made out of solid materials such as concrete. An installer is also required to have the experience and tools necessary to cut the curb to the proper length to provide a precise fit within the shower frame. A great amount of skill, experience, and the proper manpower and tools are usually required to properly install a shower curb.

Other problems, limitations and disadvantages associated with existing solutions are that multiple pieces of lumber are required. Also, installation of the three-tier two-by-four curb design requires use of screws too low in the shower area, which could possibly cause leaks. Some shower curbs are built using a PVC mesh design, which is well-known in the art. Nevertheless, this design requires the use of mortar, which takes very long to cure adding even more time to the installation process.

Accordingly, there remains a need in the art for a shower curb apparatus and method of use that reduces the materials, tools, time, and skill required to install a shower curb.

SUMMARY OF THE INVENTION

The present invention overcomes the deficiencies of the known art and the problems that remain unsolved by providing a method and respective apparatus for quickly and easily installing a shower curb.

In accordance with one implementation of the present invention, a unitary shower curb system is provided comprising:

a body having a "C"-shaped cross-section, comprising a recess, extending from a first side of the body to an opposing side of the body forming an elongated channel, wherein the elongated channel is configured to receive a lumber piece.

The purpose of this invention is to provide a one-piece shower curb, which is lightweight, easy to use and easy to install. A unitary expanded polystyrene body shaped in the form of a shower curb is provided. The body has a "C"-shaped cross-section, comprising a notch or recess, extending from one side of the body to the opposite side of the body forming an elongated channel, the elongated channel being shaped to receive a lumber piece, preferably a one-by-four piece of lumber. The body includes three sides, wherein the first side is at a ninety degree orientation with respect to an adjacent second side, and the second side is at a ninety degree orientation with respect to an adjacent third side, such that all three sides define one end of a rectangle; the recess defines the opposite end. The construction of the unitary shower curb may be either an expanded or extruded polystyrene body, with aggregate material on its exterior surface for receiving tile placement.

The unitary shower curb can be relatively easily installed. One pressure treated piece of lumber or aluminum member is installed at a shower entrance. The lumber is preferably a one-by-four piece. The lumber is placed such that the lumber stands 3.5 inches tall (in the case of a one-by-four), allowing a single piece of lumber to provide most of the height for the shower curb. This is an advantage over the prior art, which provides for the placement of three pieces of lumber stacked on top of each other to provide the height of the curb. The three-tier lumber structure may be secured to the left and right wall with an "L"-shaped bracket adjoining the lumber piece to the respective stud walls. The bracket may be installed on the side of the lumber that is facing the interior of the shower (inside face) or the bracket may be installed on the side of the lumber that is exterior to the shower (outside face).

A vinyl shower area liner is then installed in the shower area. The liner provides a water-proofing membrane to protect the lumber from water damage. The liner covers the inside face of the lumber, the top of the lumber, and the outside face of the lumber, providing water protection to all exposed sides of the lumber. Framing screws may be installed to secure the pan liner to the lumber. Thinset is then applied to the exterior surface of the shower area liner for providing a strong adhesive bond to the unitary shower curb. The unitary shower curb is then placed on top of the thinset-covered liner, so that the lumber is received into the recess of the unitary shower curb. This installation process requires less lumber, less tools, and less steps than the prior art. The known applications are for use in residential or commercial construction of shower stalls.

These and other aspects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, in which.

Like reference numerals refer to like parts throughout the several views of the drawings.

DETAILED DESCRIPTION OF THE INVENTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
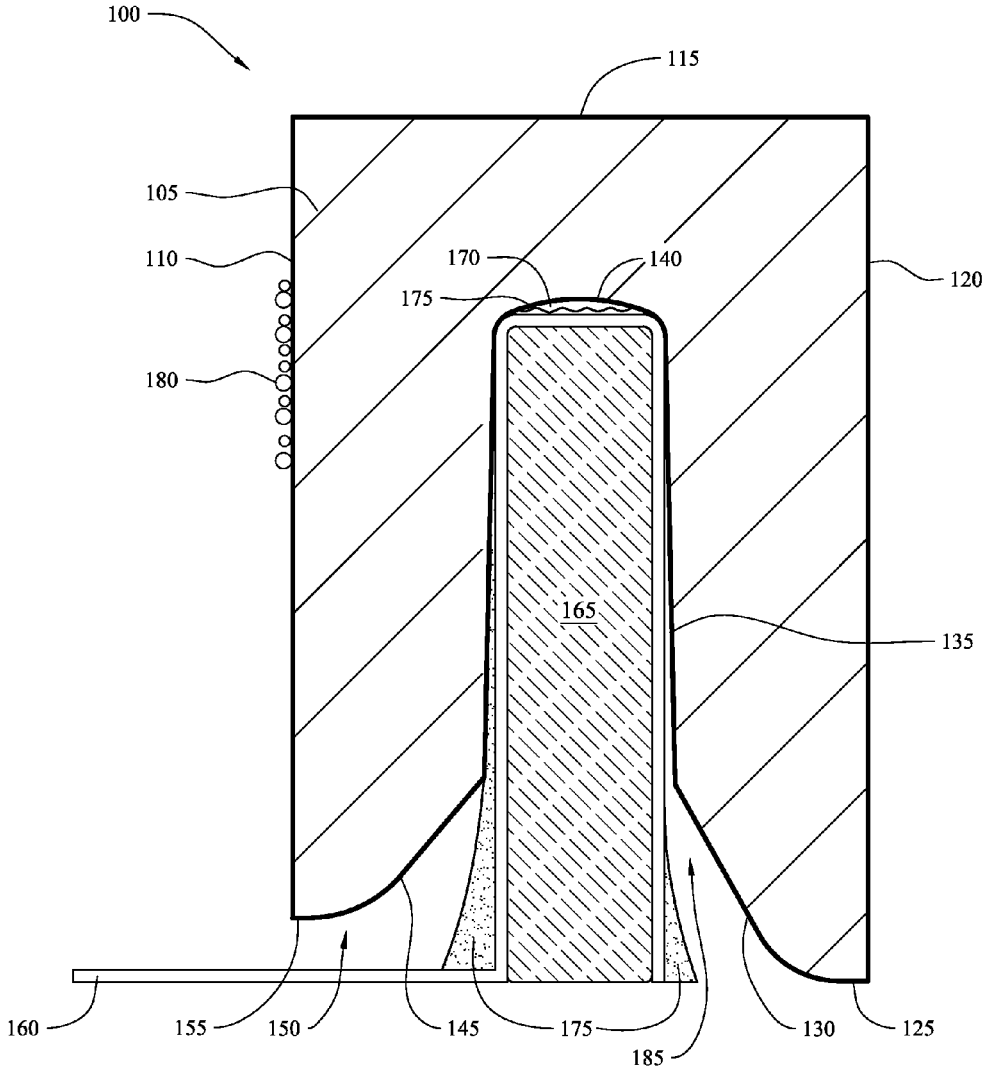
FIG. 1 presents a sectional view of a unitary shower curb in accordance with one embodiment of the present invention, in an installed configuration.

The drawing shown in FIG. 1 illustrates a sectional view of an embodiment of the unitary shower curb 100. The unitary shower curb 100 comprises a solid, block-like body 105, having a C-shaped cross-section and including a first exterior side 110 adjacent to one end of a top exterior side 115 and a second exterior side 120 adjacent to the opposing end of the top exterior side 115. The body 105 comprises a recess 185 extending along the length of the body 105, forming a receptacle for receiving a lumber support member 165. The body is preferably constructed of a rigid foam material such as expanded polystyrene (EPS), and is preferably elongated so that it extends across the width or length of a shower area entrance, as will be illustrated. The unitary shower curb 100 provides a prefabricated, easy to install shower curb.

The body 105 includes a first bottom edge 155 or corner adjoining the first exterior side 110 to a first tapered bottom edge 145 and a second bottom edge 125 adjoining the second exterior side 120 to a second tapered bottom edge 130. The second bottom edge 125 touches the tiled floor when properly installed. The spaces created by the first tapered bottom edge 145 and the second tapered bottom edge 130 are designed to allow room for an adhesive material 175, preferably thinset, to fill the space, which helps secure the unitary shower curb 100 to the lumber support member 165, more particularly, to secure the unitary shower curb 100 to a waterproof liner 160 covering the unitary shower curb 100. The tapered inner surface 135 of the recess 185 allows the lumber support member 165 to progressively hold a tight fit with the receptacle formed by the recess 185 of the unitary shower curb 100. A curved top area 140 allows room for the excess adhesive material 175 to harden and, thereby, properly secure the lumber support member 165 to the unitary shower curb 100. The first tapered bottom edge 145 is similar in function to the second tapered bottom edge 130. A gap 150 adjacent the first bottom edge 155, formed by the first bottom edge 155 of the unitary shower curb 100 and the subfloor is provided to accommodate installation of a pre-slope. The first bottom edge 155 of the unitary shower curb 100 directly contacts the floor mud of an installed shower. The waterproof liner 160 covers the exposed surfaces of the lumber support member 165, providing protection of the lumber support member 165 from water damage. A rounded gap 170 is shown at the top portion of the recess 185, formed by the curved top area 140, for receiving adhesive material 175. Aggregate material 180 is used throughout the surface of the unitary shower curb 100 to allow the final tile setting to adhere to its surface.

Figure 2:
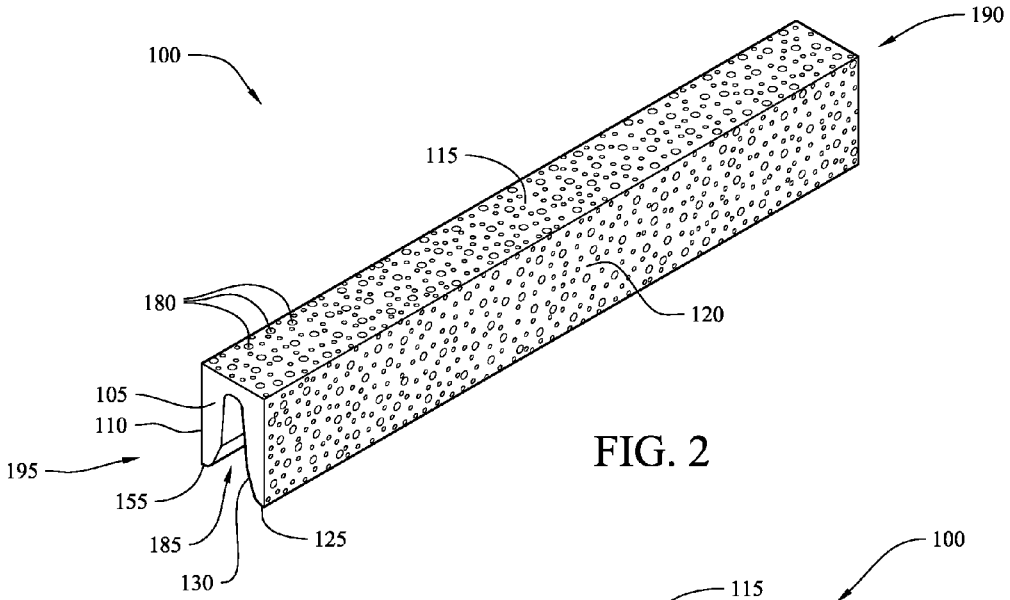
FIG. 2 presents a perspective view of the unitary shower curb originally introduced in FIG. 1, prior to installation.

The illustration of FIG. 2 presents a perspective view of the unitary shower curb 100 prior to installation within a shower. A first end 190 of the unitary shower curb body 105 can be adjusted in length to fit the width of the shower entrance. The second end 195 of the unitary shower curb 100, as illustrated in the figure, shows a partial view of the recess 185. The body 105 has a "C"-shaped cross-section, comprising the recess 185, extending from the first end 190 of the body 105 to the opposite second end 195 of the body 105, the recess 185 forming an elongated channel shaped to receive the lumber support member 165, while providing enough space to accommodate the adhesive material 175 required to secure the waterproof liner 160 to the unitary shower curb 100.

Figure 3:
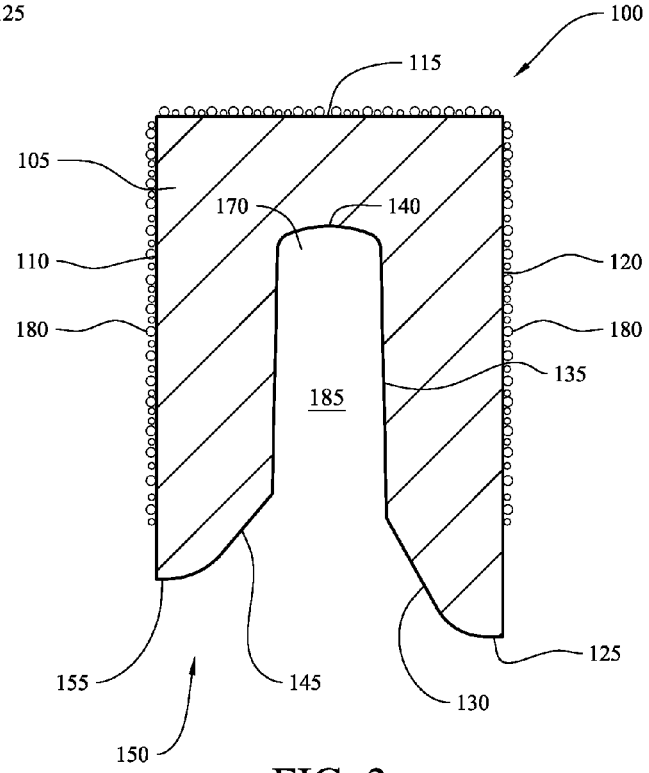
FIG. 3 presents a sectional view of the unitary shower curb originally introduced in FIG. 1, prior to installation.

The illustration of FIG. 3 presents a cross-sectional view of the unitary shower curb 100 prior to installation in the shower area, further illustrating the curves and tapered ends of the recess 185.

Figure 4:
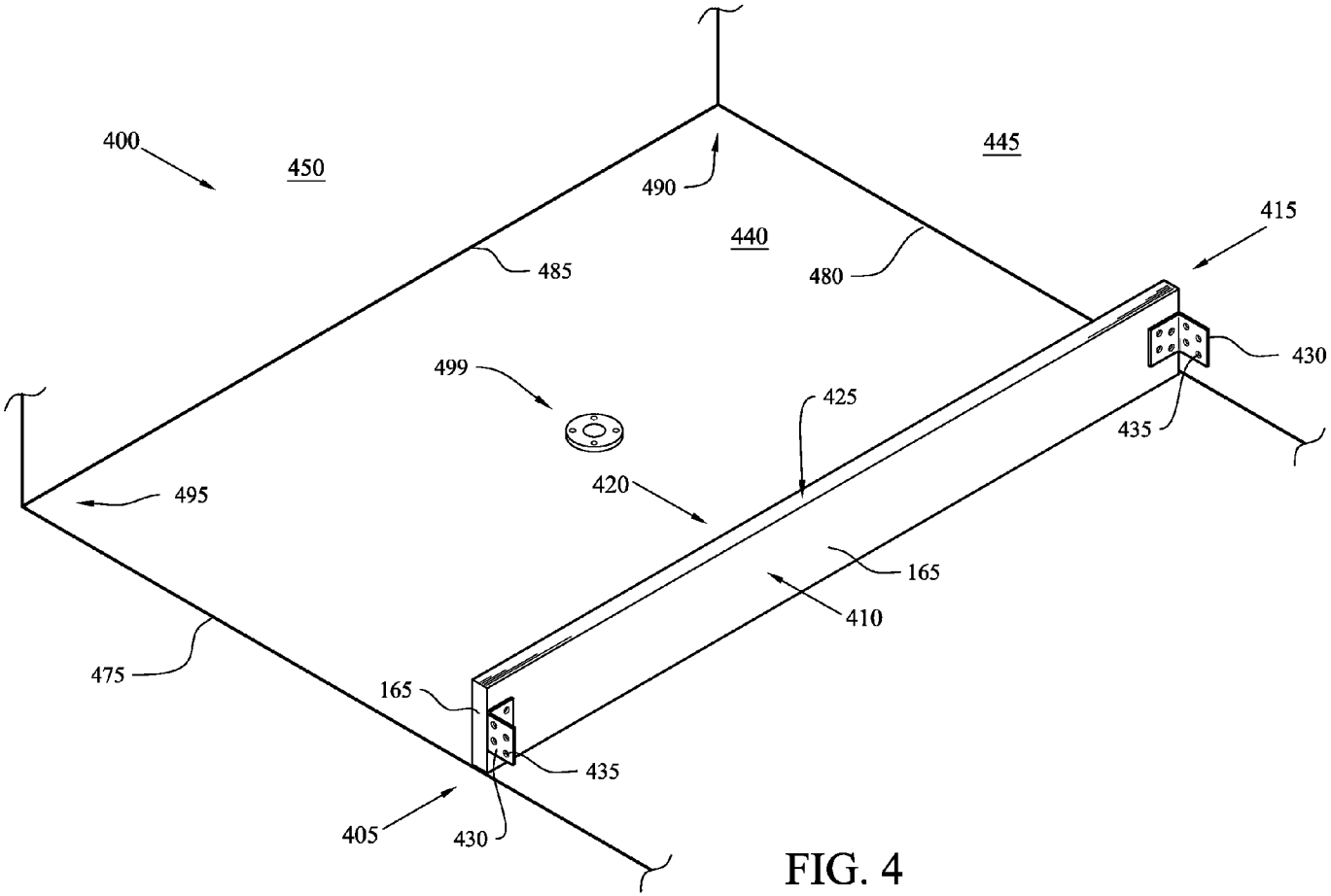
FIG. 4 presents a perspective view of a lumber support member installed in a shower area.

In turn, the illustration of FIG. 4 presents a perspective view of the lumber support member 165 installed in the shower area. A shower area 400 provides the base of the shower floor and is typically rectangular in shape. The lumber support member 165 has opposite end sides 405, 415, and is secured at the shower entrance to the wall studs (not illustrated) adjacent to each end side 405, 415 by an attachment member 430, such as an aluminum bracket, having attachment apertures 435. The front side 410, rear side 420, right end side 415, left end side 405, and top side 425 of the lumber support member 165 are illustrated in the figure, prior to beginning the water-proofing and shower curb installation process. The shower area 400 is delimited by a subfloor or flat bottom surface 440. A first shower sidewall 445 extends upwardly from a first bottom edge 480 of the bottom surface 440; a second shower sidewall 450 extends upwardly from a second bottom edge 485 of the bottom surface 440; and a third shower sidewall (not shown) extends upwardly from a third bottom edge 475 of the bottom surface 440. A drain is covered with a top flange 499 that provides a collar around the drain hole. The top flange 499 is used to properly prevent any debris from falling into the drain and clogging the plumbing once the installation is complete. The corner vertexes 490, 495 (two remaining corner vertexes of the rectangular shower area 400 are not shown) are angled downward and directed towards the center of the shower area 400 towards the drain so that water that is accumulated will flow, due to the force of gravity, into the shower drain. The slope pitch is typically 0.25 inches for every linear foot in length to the shower drain hole.

Figure 5:
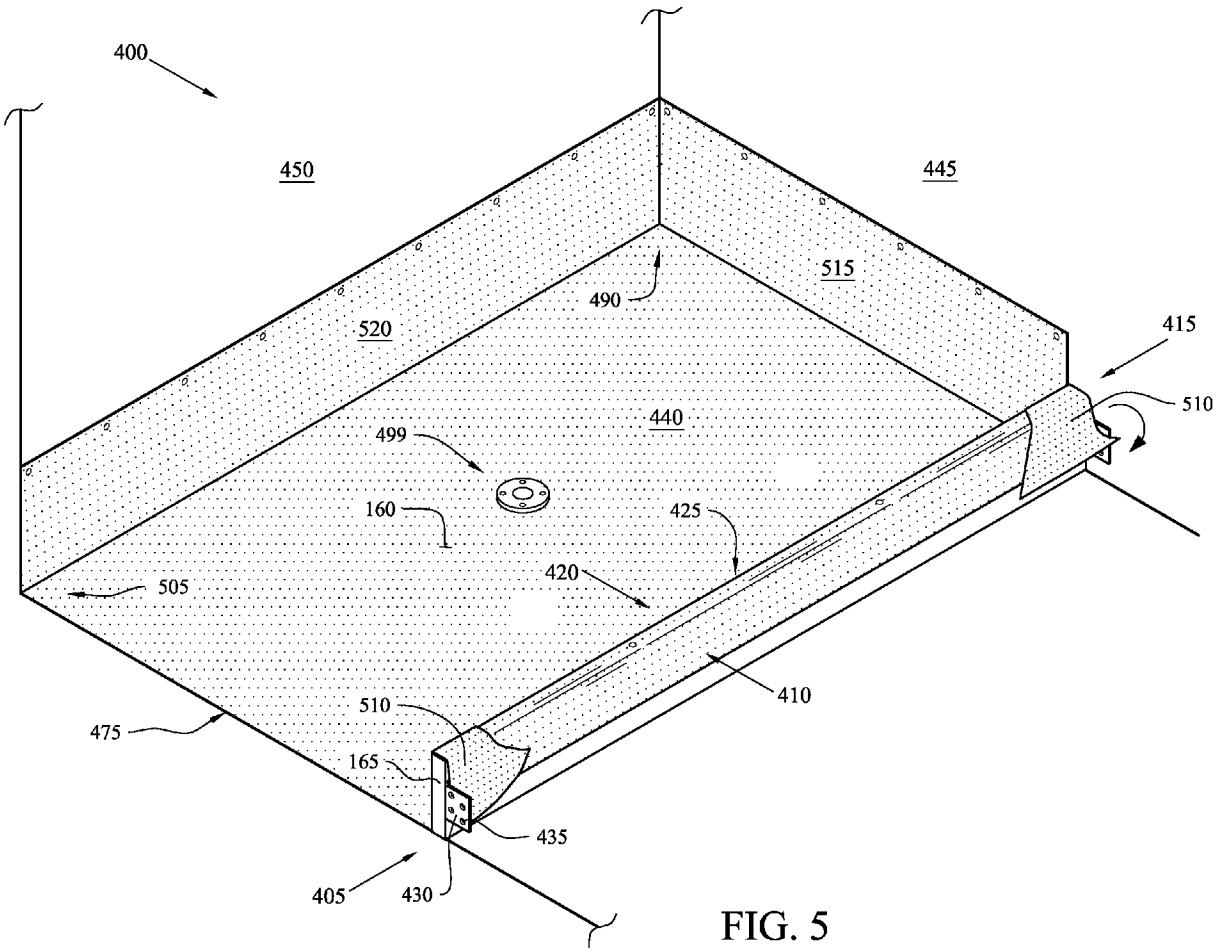
FIG. 5 presents a perspective view of the lumber support member installed in the shower area and covered with the waterproof liner.

In a further phase of the installation process illustrated in FIG. 5, the lumber support member 165 is covered with the waterproof liner 160. The method used for covering the lumber support member 165 with the liner 160 may be any known method. The preferred method is to install the waterproof liner 160 completely around the bottom surface 440 of the shower area 400 and extending upwardly at least eight inches from the bottom surface 440 on each stud wall. The lumber support member 165 is secured to the edge or edges of the shower area 400 that provides the shower entrance by attachment screws (now shown) secured via the attachment apertures 435 on the attachment members 430. Significantly, a diagonal cut is made to the corners of the waterproof liner 160 adjacent to the attachment members 430, creating a triangular-shaped liner piece 510 that can be placed over the liner 160 that is laid over the surface of the lumber support member 165, providing two layers of overlapping liner 160 located at each end side 405, 415 of the lumber support member 165. This removes the excess liner material from the entrance corners of the shower area 400, minimizing a bulky appearance on the wall corners once tiles are installed. It also helps to more securely attach the unitary shower curb 100 to the lumber support member 165, by causing the lumber support member 165 to form a more tight fit within the recess 185 of the unitary shower curb 100 at both ends of the unitary shower curb 100 where the excess liner material is overlapping.

Figure 6:
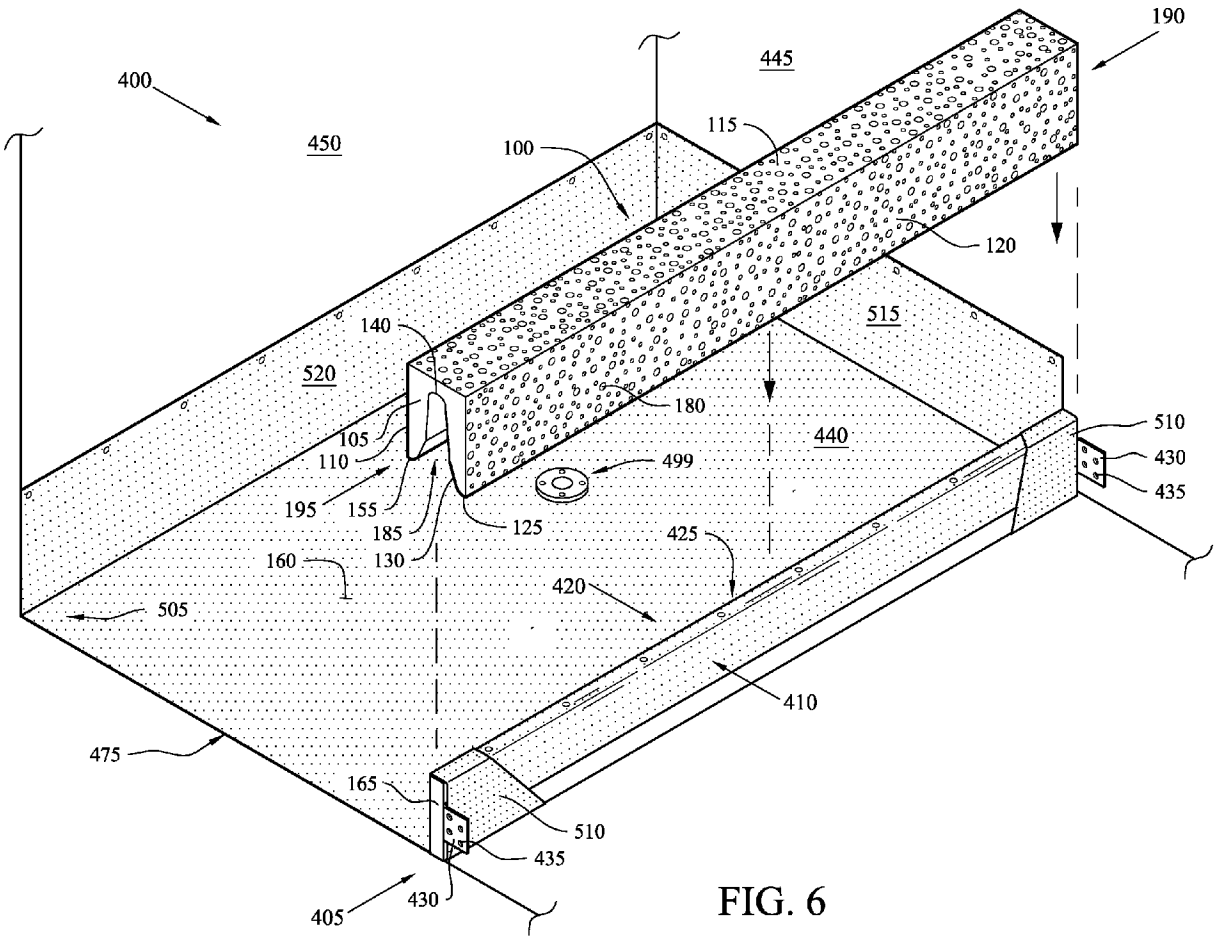
FIG. 6 presents a perspective view of the unitary shower curb originally introduced in FIG. 1, being installed on the lumber support member in the shower area.

In a further step shown in FIG. 6, the unitary shower curb 100 is installed onto the lumber support member 165 by assembling and fitting the unitary shower curb 100 vertically downward and onto the lumber support member 165. An adhesive material, such as the adhesive material 175 shown in FIG. 1 (e.g., thinset), is applied onto the liner 160 covering the lumber support member 165 (prior to securing the unitary shower curb 100 onto the lumber support member 165). The ends of the elongated body 105 may be cut to a proper length according to the width of the shower entrance to ensure a secure fit.

Figure 7:
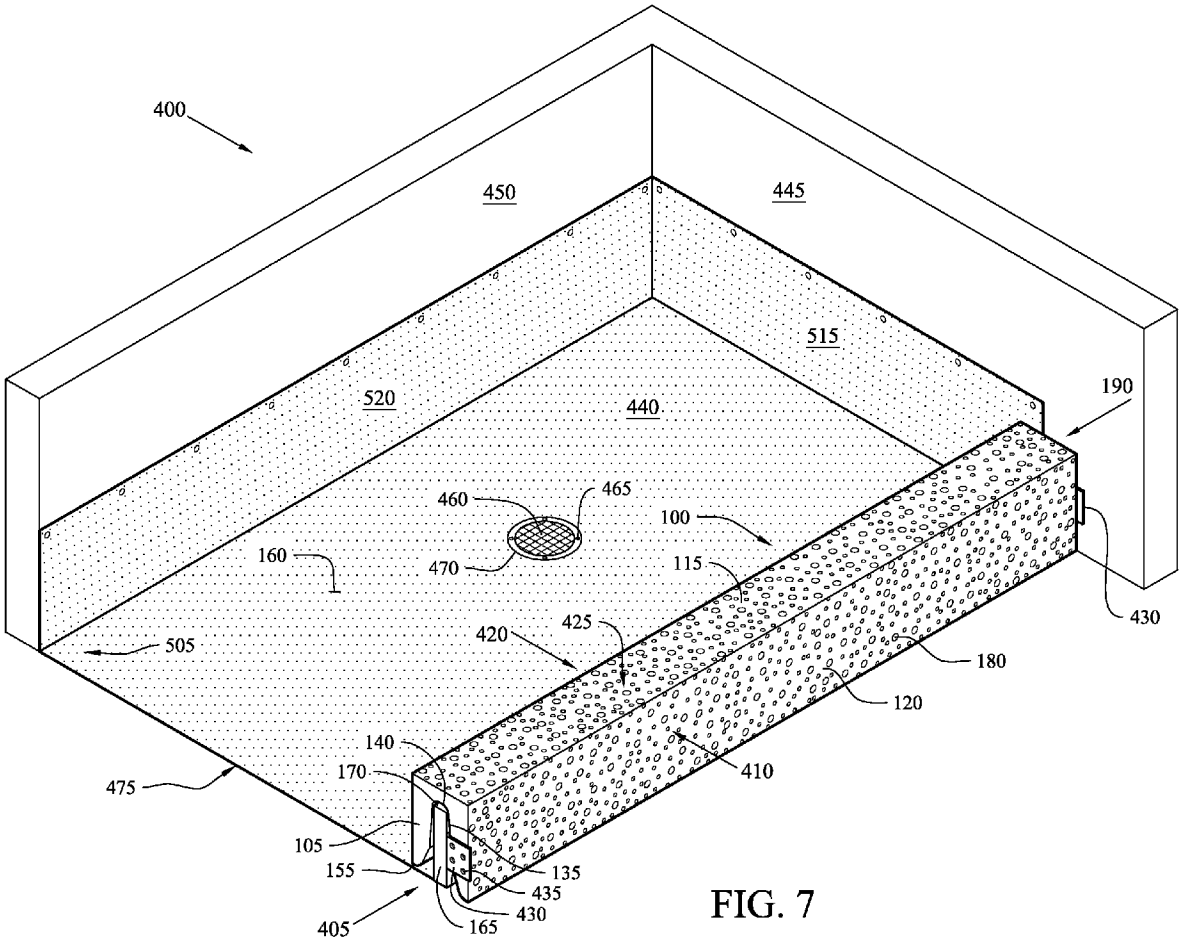
FIG. 7 presents a perspective view of the unitary shower curb originally introduced in FIG. 1, once it has been fitted onto the lumber support member.

The illustration of FIG. 7 shows the unitary shower curb 100 once it has been fitted onto the lumber support member 165. The shower curb recess 185 has mated with the lumber support member 165 and is secured via the adhesive material 175. A structure is formed, having the height and width required to prevent shower water from overflowing outside the shower stall onto an exterior bathroom floor. The top flange 499 on the drain, which was shown in FIGS. 4 through 6 and which is normally used primarily for installation purposes, has been replaced with a shower screen 460 secured by four screws 465 arranged around the shower screen edge 470.

With special mudding compound or foam, a slope may be created from the bottom surface 440, tilting downwards towards shower screen 460 at an angle of 0.25 inches per linear foot. Tiles are then laid using thin set and waterproof grout throughout to cover the spacing between the tiles. Tile is also secured to the unitary shower curb by placing thinset that securely attaches to the aggregate material covering its surface and forming a strong bond.

Figure 8:
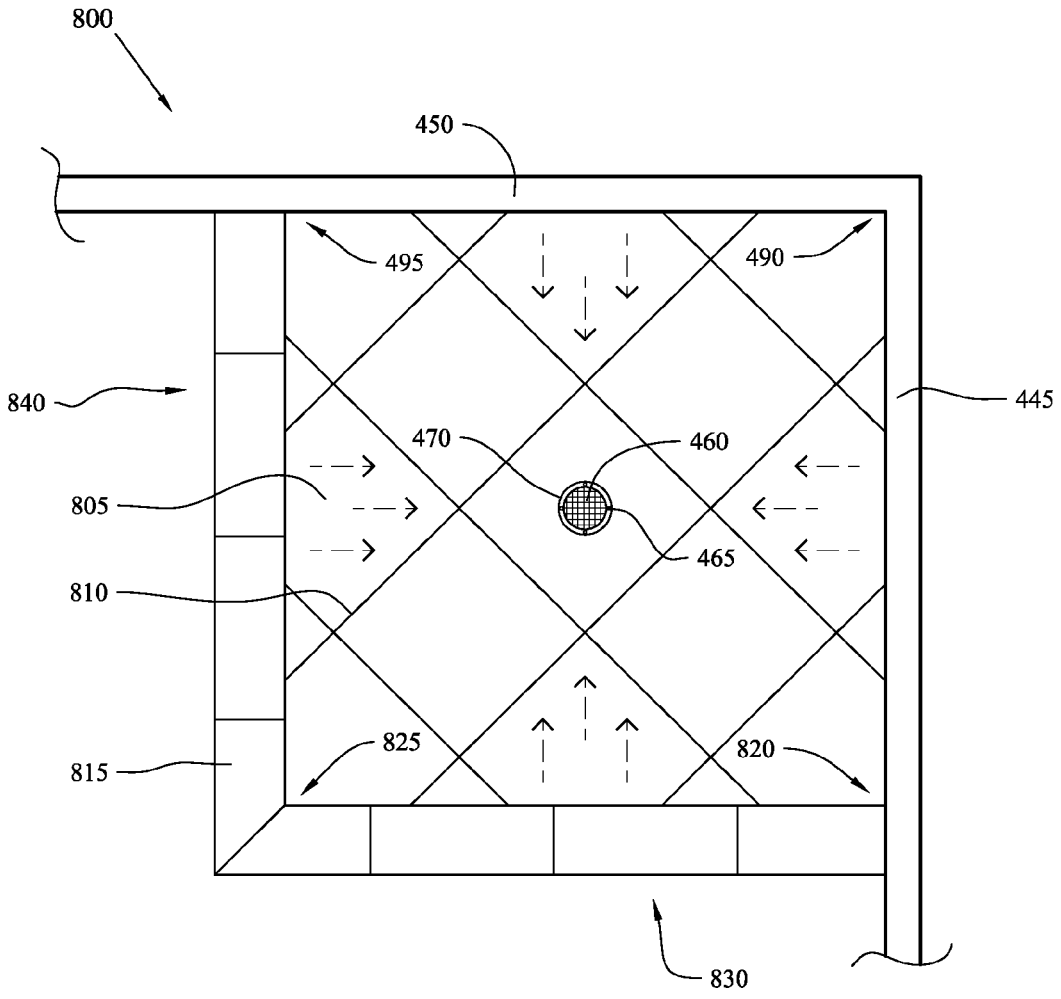
FIG. 8 presents a top view of an alternative embodiment of the unitary shower curb, in an installed configuration, illustrating tiles covering the shower area and the peripheral area.

The drawing of FIG. 8 presents a top plan view of a second embodiment of the invention, consisting of a unitary shower curb system 800 fully installed with tiles covering the peripheral area. The alternative embodiment shows a top view of a shower having a two-sided entrance necessitating a configuration of the unitary shower curb 800, having a forty-five degree angle shaped to mate two unitary shower curbs 830, 840, thereby forming a singular shower curb for an "L"-shaped two-sided shower entrance. The two unitary shower curbs 830, 840 are preferably attached to each other by applicable fasteners such as screws, nails, staples, adhesive or the like. The shower area 805 is shown in its finished form, i.e. completely tiled. Grout 810 is used to fill in the gaps between the individual tiles. The unitary shower curbs 830, 840 are also covered with tiles 815. The corner vertexes 490, 495, 820 and 825 and the sides of the shower area 805 are shown having a downward slope towards the shower screen 460 and shower screen edge 470 that cover the drain.

Alternative embodiments are contemplated in which the unitary shower curb body could be shorter in length and several bodies could be mounted consecutively along the lumber support member 165. Such an arrangement would make the unitary curb system modular and easily adaptable to different lengths without having to cut the body.

In addition, the lumber support member could be replaced with alternative support members such as an aluminum beam, bricks, or the like. A person skilled in the art will understand that any rigid support member capable of being arranged along a shower entrance area could perform the function of supporting the unitary shower curb body. However, having a lumber support member is preferred, as it provides convenient mechanical support of the body at reasonable cost.

The above described embodiments are merely exemplary illustrations of implementations set forth for a clear understanding of the principles of the invention. Many variations, combinations, modifications or equivalents may be substituted for elements thereof without departing from the scope of the invention. Therefore, it is intended that the invention not be limited to the particular embodiments disclosed as the best mode contemplated for carrying out this invention, but that the invention will include all the embodiments falling within the scope of the appended claims.

What is claimed is:

1. A unitary shower curb system, comprising:

at least one body having a C-shaped cross-section and comprising a recess, wherein the recess extends from a first end of the body to an opposing end of the body forming a channel, wherein the channel is configured to receive an elongated support member;

wherein the body comprises a first exterior side and an opposed second exterior side, the body further comprising a first bottom edge adjoining the first exterior side to a first interior surface, the first interior surface extending from a top of the body to the first bottom edge, and a second bottom edge adjoining the second exterior side to a second interior surface, the second interior surface extending from a top of the body to the second bottom edge, the first and second interior surfaces each being tapered toward a top of the body to apply a tighter fit to an upper portion of the elongated support member than to a lower portion of the elongated support member; and wherein the body includes a curved interior top area extending between the exterior sides of the body from one of the interior surfaces to an opposite one of the interior surfaces to define a curved portion of the recess toward a top surface of the body such that the curved portion of the recess allows room for adhesive material to harden on top of the elongated support member and thereby properly secure the curved interior top area of the body to the elongated support member.

2. The unitary shower curb system of claim 1, wherein the body is a solid block.

3. The unitary shower curb system of claim 2, wherein the body is manufactured of polystyrene.

4. The unitary shower curb system of claim 1, wherein the second exterior side is taller than the first exterior side.

5. The unitary shower curb system of claim 1, wherein the body and the recess are elongated.

6. A unitary shower curb system, comprising:

a support member, having a front side, a rear side, a top side and two opposing end sides;

at least one body having a C-shaped cross-section and comprising a recess, wherein the recess extends from a first end of the body to an opposing end of the body forming a channel, wherein the channel is configured to at least partially receive said support member so that at least part of the top side and at least part of the front side and rear side of the support member are housed inside the channel;

wherein the body comprises a first exterior side and an opposed second exterior side, the body further comprising a first bottom edge adjoining the first exterior side to an interior lower portion of a first interior surface and a second bottom edge adjoining the second exterior side to an interior lower portion of a second interior surface, the first and second interior surfaces each being tapered toward a top of the body such that a space between the first and second exterior sides increases in a direction toward a bottom of the body;

wherein the first and second interior surfaces each include a respective interior upper portion, where each respective interior upper portion has a distinct angle relative to each respective interior lower portion of each of the interior surfaces such that a respective lower space is defined between each of the respective interior lower portions and the elongated support member when the elongated support member is received through the recess, to allow room for an adhesive material to fill each respective lower space and to help secure the interior surfaces to the elongated support member, where each respective interior lower portion and each respective interior upper portion is configured such that when the elongated support member is received in the recess, a minimum width of each respective lower space between each respective interior lower portion and the elongated support member is greater than a maximum distance between each respective interior upper portion and the elongated support member;

wherein the first and second interior surfaces are configured to apply a tighter fit to an upper portion of the elongated support member than a lower portion of the elongated support member due to distinct angles of each of the respective interior upper and lower portions relative to one another;

wherein each respective upper portion and lower portion is planar; and wherein the bottom edges are vertically offset to create a gap to accommodate installation of a pre-slope.

7. The unitary shower curb system of claim 6, further comprising a waterproof liner configured to be arranged between the support member and the body.

8. The unitary shower curb system of claim 7, further comprising an adhesive material configured to be arranged between the waterproof liner and the body.

9. The unitary shower curb system of claim 8, wherein the second exterior side is taller than the first exterior side.

* * * * *